US006860685B2

(12) United States Patent
Thomson et al.

(10) Patent No.: US 6,860,685 B2
(45) Date of Patent: Mar. 1, 2005

(54) DOOR EDGE PROTECTION SYSTEM FOR CONVENTIONAL AUTORACK RAILCARS

(75) Inventors: Stuart H. Thomson, Downsers Grove, IL (US); Mark Y. Zhan, Frankfort, IL (US)

(73) Assignee: Holland L.P., Crete, IL (US)

( * ) Notice: Subject to any disclaimer, the term of this patent is extended or adjusted under 35 U.S.C. 154(b) by 6 days.

(21) Appl. No.: 10/056,572

(22) Filed: Jan. 24, 2002

(65) Prior Publication Data

US 2002/0067970 A1 Jun. 6, 2002

Related U.S. Application Data

(63) Continuation-in-part of application No. 09/732,606, filed on Dec. 8, 2000, now Pat. No. 6,503,037, which is a continuation-in-part of application No. 09/267,436, filed on Mar. 12, 1999, now abandoned.

(60) Provisional application No. 60/077,815, filed on Mar. 12, 1998.

(51) Int. Cl.[7] ..... B60P 7/08

(52) U.S. Cl. ..... 410/87; 410/4; 410/26; 410/117; 410/118

(58) Field of Search ..... 410/3, 4, 24, 26, 410/87, 117, 118, 119, 155; 105/355, 374, 394; 49/462, 498.1; 293/109, 128, 122

(56) References Cited

U.S. PATENT DOCUMENTS

| | | | | | |
|---|---|---|---|---|---|
| 1,126,243 | A | * | 1/1915 | McQuown | 410/118 |
| 3,067,699 | A | * | 12/1962 | Fredriks | 410/119 |
| 5,415,108 | A | * | 5/1995 | Murphy et al. | |
| 5,527,139 | A | * | 6/1996 | Bruder et al. | 410/117 |
| 5,579,697 | A | * | 12/1996 | Burke | |
| 5,669,745 | A | * | 9/1997 | Anderson | 410/87 |
| 6,503,037 | B2 | * | 1/2003 | Thomson et al. | 410/117 |
| 6,561,740 | B1 | * | 5/2003 | Burke et al. | 410/87 |
| 2002/0127078 | A1 | * | 9/2002 | Schorr et al. | 410/87 |

* cited by examiner

*Primary Examiner*—Stephen Gordon
(74) *Attorney, Agent, or Firm*—David C. Brezina; Barnes & Thornburg

(57) ABSTRACT

The present invention provides a cushioning system to be applied to the inside surface of the walls of conventional autorack railcars. More particularly, the present invention is directed toward the easy application of a foam protector of single or double tube configuration to the side portions of the metal screen walls that make up an autorack railcar. Improvements enable a multiple density foam tube, a "Logo" panel bar and an improved fastener. The tubes are designed to protect the edges of car doors by collapsing when hit by the car door and quickly bouncing back, regardless of temperature.

3 Claims, 7 Drawing Sheets

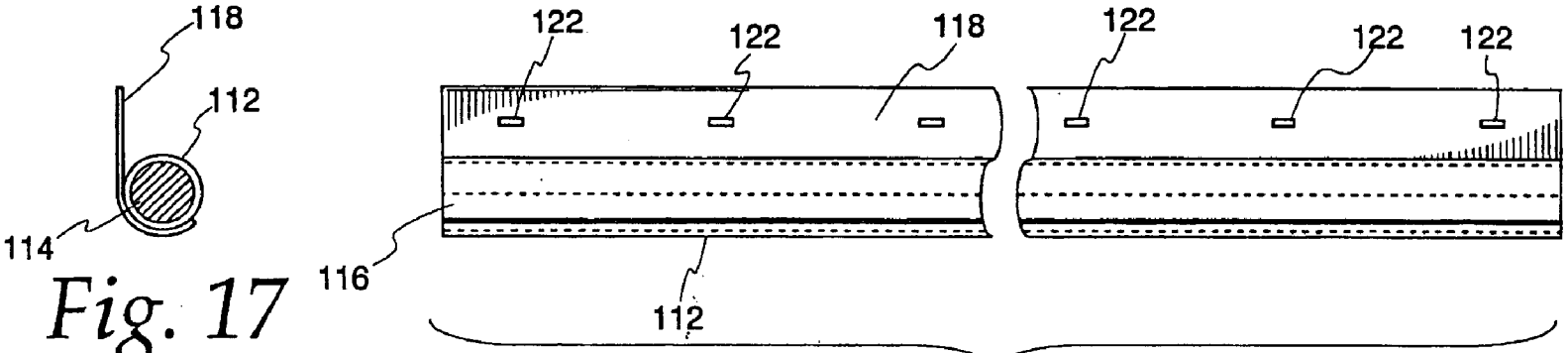
Fig. 17
Fig. 18
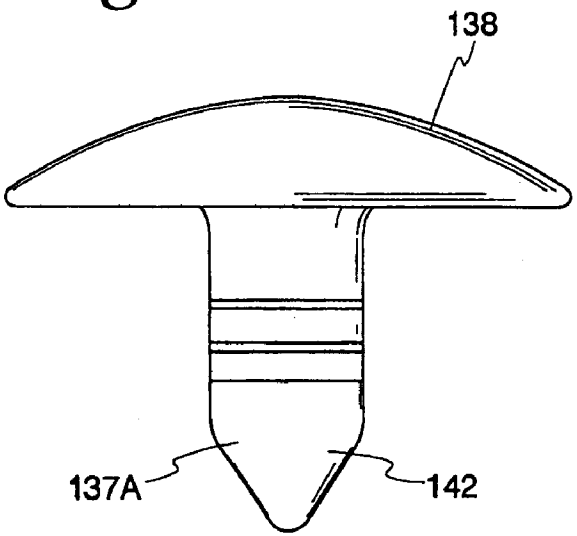
Fig. 16
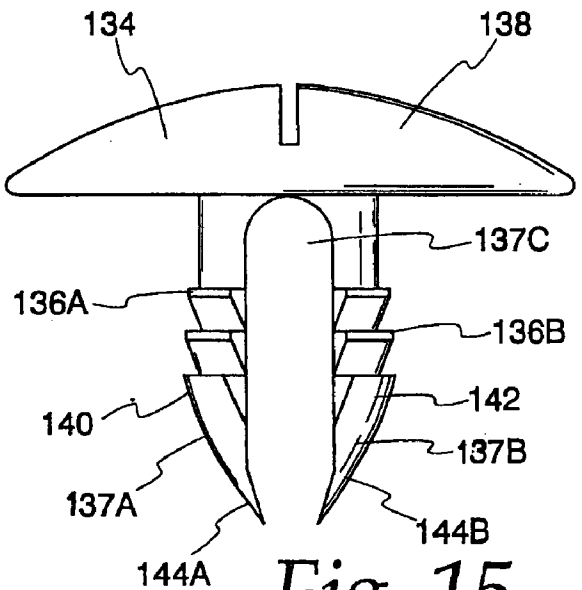
Fig. 15

DOOR EDGE PROTECTION SYSTEM FOR CONVENTIONAL AUTORACK RAILCARS

RELATED APPLICATIONS

This application claims the benefit of U.S. Provisional Application No. 60/077,815, filed Mar. 12, 1998. This application also claims the benefit of U.S. patent application Ser. No. 09/267,436, filed Mar. 12, 1999, which is now abandoned. This application is a Continuation in Part of U.S. Nonprovisional application Ser. No. 09/732,606 filed Dec. 8, 2000 now U.S. Pat No. 6,503,037, which is a continuation-in-part of Ser. No. 09/267,436.

BACKGROUND OF THE INVENTION

Since the early 1960's with the introduction of multi-level autorack structures which transport automobiles and other vehicles on flatcars, railroads have gained substantial market share from highway carriers. Railroads purchase the rack structure which is applied to a flatcar provided to that railroad. The racks are built to carry either two or three levels of vehicles, depending on rail clearances and the heights of vehicles being transported. Auto sizes and industry requirements have changed over time and rack designs have evolved from simple, open frames to complex, fully-enclosed structures. As a result there are now several different flatcar types in this service, all of which have hydraulic end-of-car cushioning. The autorack railcar of conventional construction has side walls are actually screens having many holes therethrough for air and light and to protect against flying objects which could injure the automobiles in transit. The walls are supported by posts or struts.

There is a need in the autorack freight car industry to provide protection to the automobiles being transported. It is common for one of the doors of an automobile to swing open during transport, colliding with one of the side walls of the autorack freight car and causing expensive damage to the door of the vehicle. This same type of damage can also be caused by the careless opening of the car door after it has been driven onto the freight car, or later on when it is time to remove the vehicle.

Prior art techniques for cushioning and protecting the edges of car doors from any impact with the walls of the autorack freight cars are expensive and time-consuming to properly mount. Furthermore, prior art systems of this nature require protruding material that restrict the ability of the workers to do their jobs. The invention is an improvement over such prior art systems as disclosed in U.S. Pat. No. 5,311,823 to Rudebaugh et al. and U.S. Pat No. 5,762,001 to Dworakowski. It is the object of the present invention to provide a large degree of protection along the side walls of an autorack freight car at a low cost and with ease of installation.

The improvements adapt the method and apparatus to additional unique considerations and improve certain aspects of the product as to the environment in which it is used, particularly as to providing improved installation, economy and operation recognizing the particular needs of door edge protection as distinguished from more complex solutions that are derived from more traditional rail car product protection principles which are then wasteful of resources and provide unnecessary and complex systems for the door edge protection task.

SUMMARY OF THE INVENTION

In order to accomplish this objective, the present invention provides a door edge protection system to be applied to the inside surface of the walls of conventional autorack railcars. More particularly, the present invention is directed toward the easy application of a foam protector of single or double tube configuration to the side portions of the metal screen walls of autorack railcars. The tubes are designed to protect the edges of car doors by providing a cushion which will partially collapse when hit by the car door and resiliently return to its tubular shape regardless of temperature.

The original door edge protection system of this invention is for conventional auto track railcars for transporting automobiles. The railcars have side walls with holes therethrough to permit passage of light and air. This door edge protection system includes a resilient foam cushioning material covering a portion of at least one of the railcar side walls at the level of the doors of the automobiles being transported so that when the door of an automobile is opened, the material would be positioned between the door and the railcar side wall covered by said material for cushioning and protecting the automobile door edge against impact with the railcar side wall. Penetrating fasteners are provided for securing fastening the cushioning means to the innersurface of the side walls of the railcar. Each of the fasteners has a leg extending through the cushioning material and preferably through a slot cut in the cushioning material and into at least one of the holes in the railcar side wall. The fastener leg has a locking formation for permitting it to pass through the hole in the railcar side wall but resiliently engaging the exterior of the side wall and locking the fastener in place after the fastener leg has passed through the hole in the side wall.

It is a feature of this invention that at least one end of the cushioning material is rolled into a tube and another portion of the foam material extends tangentially out from the tube, providing a flat surface which is attached to the interior side wall of the railcar by means of the aforementioned fasteners. In the preferred embodiment, both ends of the foam material are rolled to form a pair of substantially parallel coextensive tubes which are spaced apart by a flat portion of material that forms the attachment means to the side wall of the railcar by means of the fasteners.

The single or double tube configuration is used in conjunction with a separate flat piece of foam protector of varying width to be mounted over the railcar posts to offer protection for various heights of door trim.

The cushioning door edge protection system is installed by specially designed plastic push-pin fasteners that attach to the metal screen walls of conventional autorack railcars. These fasteners are easy to install but very difficult to remove. Multiple slots for the placement of the plastic fasteners are provided along the foam cushioning to allow for ample fastening flexibility.

A modified version of the door edge protection invention has an improved structure that enables elimination of the double tube on the lower deck of the autorack car and use of a single tube on all levels. An improved backing sheet bond or weld, and a less dense foam insert in the tube provide increased protection under door edge protection conditions, with improved economy and utility. The higher density, outer foam layer further has a coating to provided added durability and door edge protection. Additional features of the modified version include an improved fastener, and an added protection component mountable in that portion of the car that does not have fastener receivable openings. Yet another modification eliminates the tube entirely, providing instead a foam rod that is directly bonded to the backing sheet.

These features and advantages, as well as others which inhere in the various embodiments of the invention, will be more fully appreciated after a reading of the following detailed description, when taken in conjunction with the following drawings, also described below.

BRIEF DESCRIPTION OF THE DRAWINGS

FIG. 15 is a side elevational view of the modified push pin fastener that is used to mount the various embodiments of the foam cushioning material of the present invention to the metal screen of a conventional autorack railcar;

FIG. 16 is a front elevational view of the push pin fastener;

FIG. 17 is a side elevational view showing an uninstalled single tube door edge protector.

FIG. 18 is a front elevational view showing an uninstalled single tube door edge protector.

DETAILED DESCRIPTION OF THE INVENTION

Referring to FIGS. 1–5, a cushioning foam material 10 is provided for the purpose of providing impact protection along the inner surface of the side walls 11 of an autorack railcar at a low cost. The cushioning material 10 is formed of a resilient closed cell material that resists grease, oil and dirt, and does not absorb water. In a preferred embodiment of the present invention, this closed cell material is a cross-linked polyolefin foam, such as OLETEX™ cross-linked olefin foam. It remains functional and resilient throughout a broad spectrum of thermal temperatures, handling temperatures anywhere from −60° F. up to 180° F. without distortion.

Figure 1:
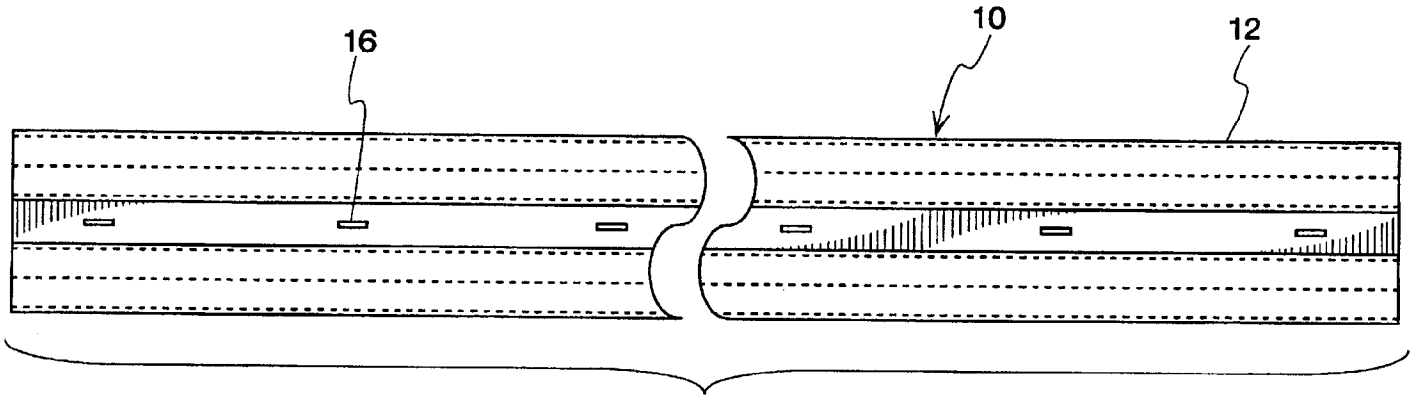
FIG. 1 is a front elevational view of one embodiment of a door edge protection system constructed in accordance with the present invention featuring a double tube of cushioning foam material.
Figure 2:
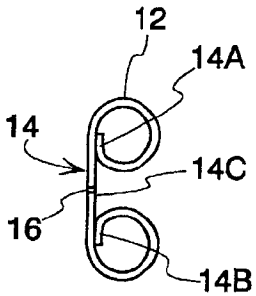
FIG. 2 is a side elevational view of the embodiment of FIG. 1.

With specific reference to FIGS. 1 and 2, in accordance with the preferred embodiment of the invention, the first component of this invention is a unique multiple tube configuration foam protector 12. The tubes 12 will resiliently be engaged by and collapse when hit by a car door but quickly bounce back regardless of temperature. In this embodiment there are two tubes but it will be understood that there can be several tubes or even a single tube, as will be further explained. The tubes 12 are made by a unique process that uses the backing piece of a flat piece of foam material 14 the ends 14*a* and 14*b* of which are rolled over and welded to the intermediate portion 14*c*, thereby forming a pair of parallel tubes which are separated by the flat intermediate portion 14*c* double tube configuration. The intermediate portion of material 14*c* has slotted holes 16 to accommodate penetrating fasteners and to allow for ease in installation. This configuration allows for protection of automobiles and particularly, the automobile doors, being transported by railcars, providing cushioning along the walls. However, workers are not restricted by the protruding material like as other prior art systems.

Figure 3:
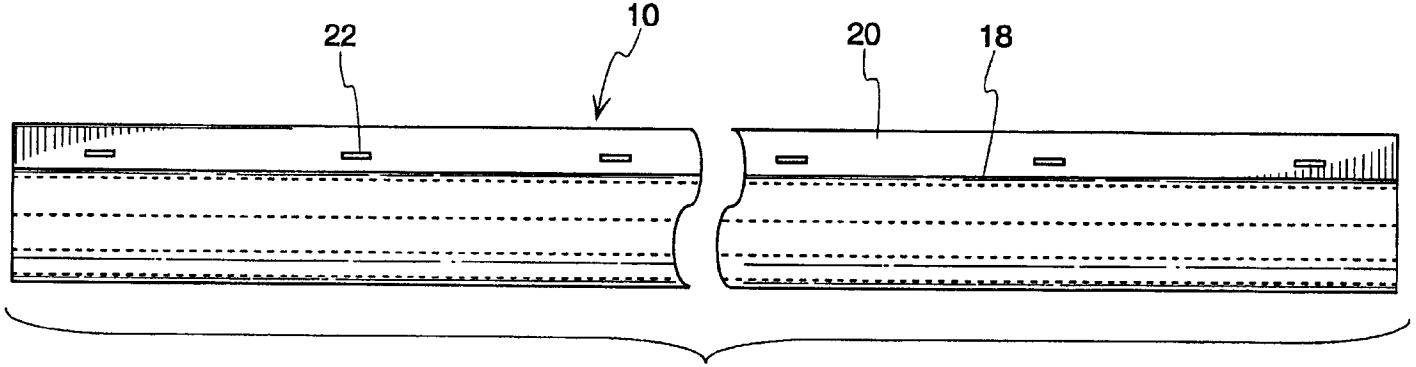
FIG. 3 is a front elevational view of another embodiment of the invention featuring a single tube of cushioning foam material.
Figure 4:
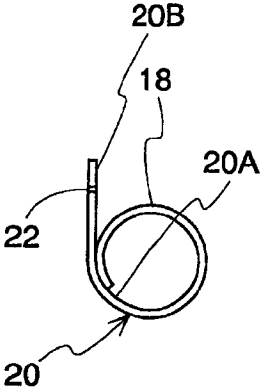
FIG. 4 is a side elevational view of the embodiment of FIG. 3.

FIGS. 3 and 4 illustrate a second embodiment of the invention, whereby the first component is a single tube configuration foam protector 18. The single tube 18 is made by a process similar to the process used to make the double tube protector 12 of FIGS. 1 and 2, except that only one end in 20*a* the backing piece of a flat piece of foam material 20 is rolled over and welded into a single tube and the other end 20*b* remains flat to provide attachment to the railcar side wall. The flat portion 20*b* also has slotted holes 22 to accommodate penetrating fasteners and allow for ease in installation. This single tube, Configuration 18, serves the same cushioning purpose as the double tube configuration 12.

Figure 5:
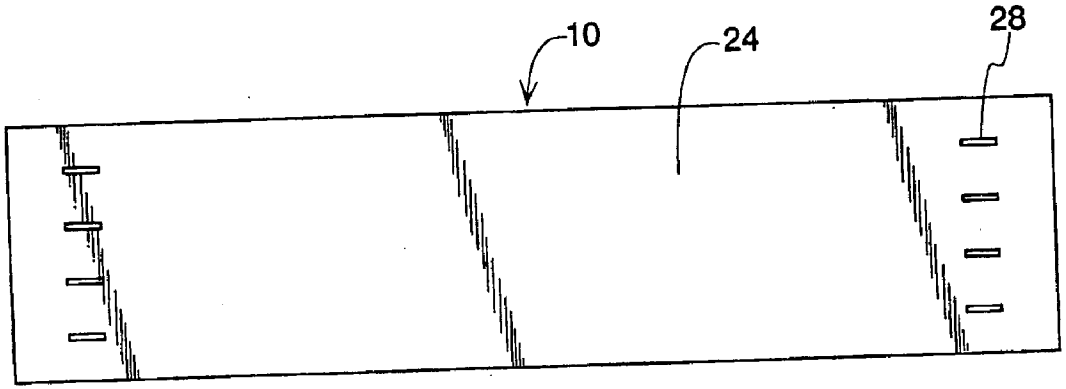
FIG. 5 is a front elevational view of the flat post or strut covering foam material of the present invention.
Figure 7:
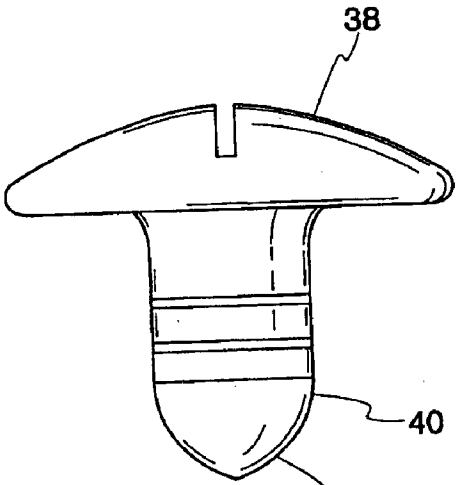
FIG. 7 is a front elevational view of the push pin fastener.
Figure 8:
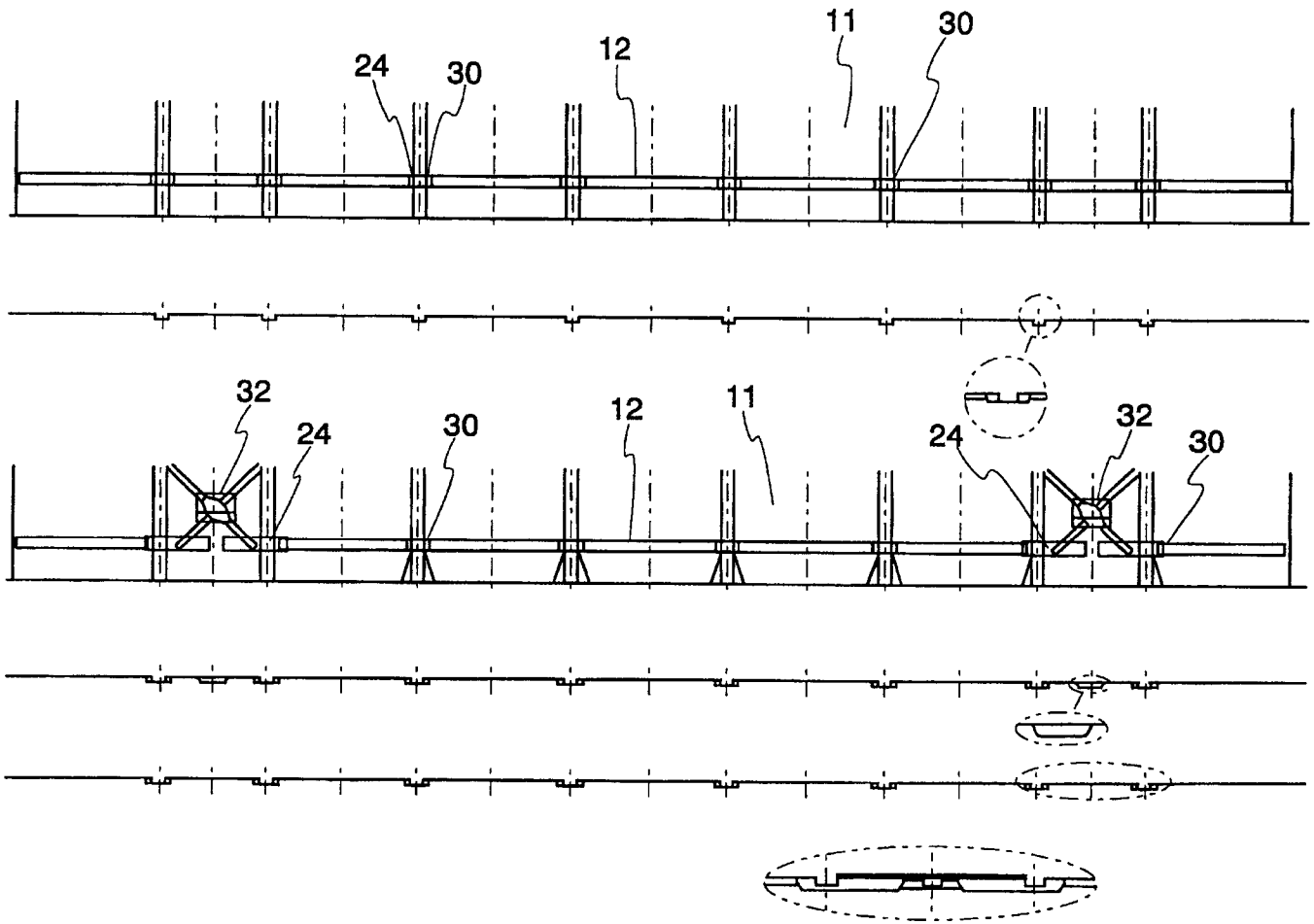
FIG. 8 is a front elevational view of the various embodiments of the present invention mounted on the inner surface of the walls of a two-story autorack railcar.
Figure 9:
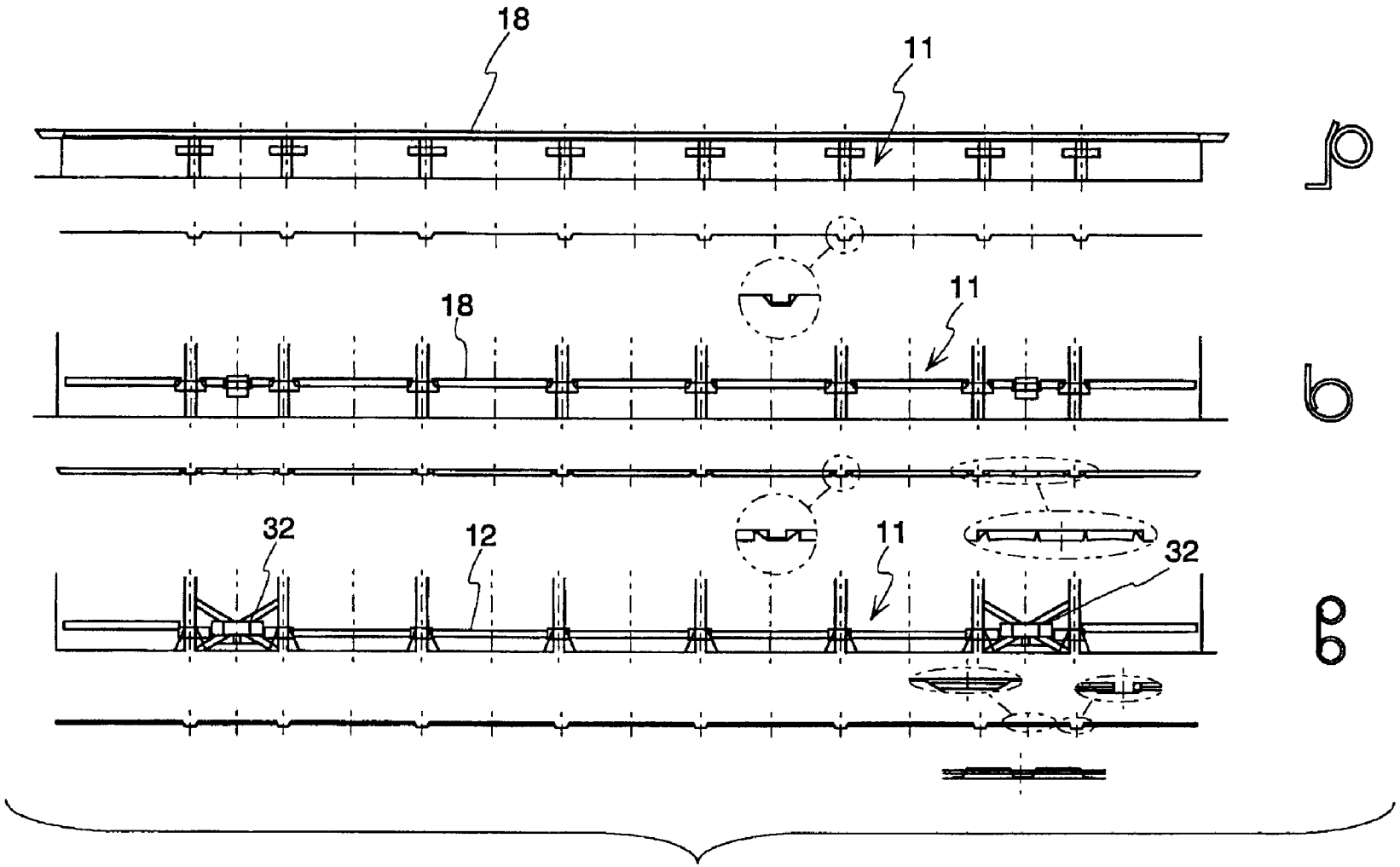
FIG. 9 is a front view of the various embodiments of the present invention mounted on the inner surface of the walls of a three-story autorack railcar.
Figure 10:
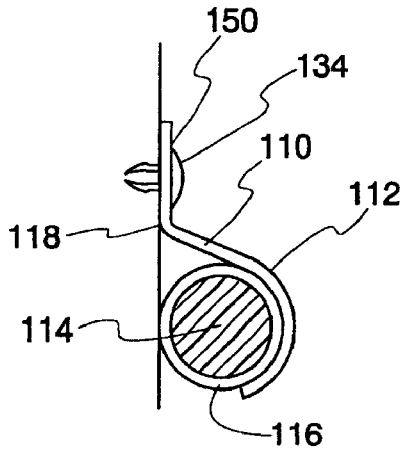
FIG. 10 is sectional view of the modified filled single tube embodiment.
Figure 11:
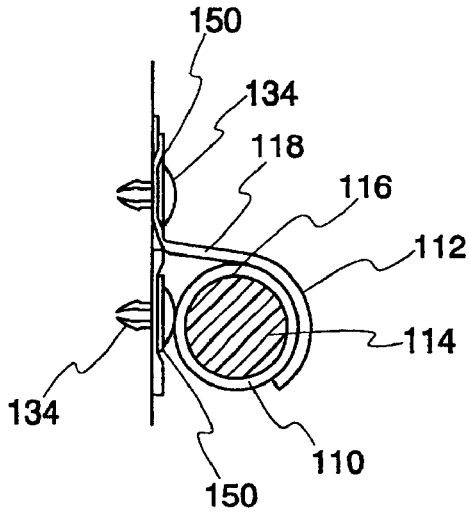
FIG. 11 is a sectional view of the modified filled single tube embodiment, mounted with an additional pad.
Figure 12:
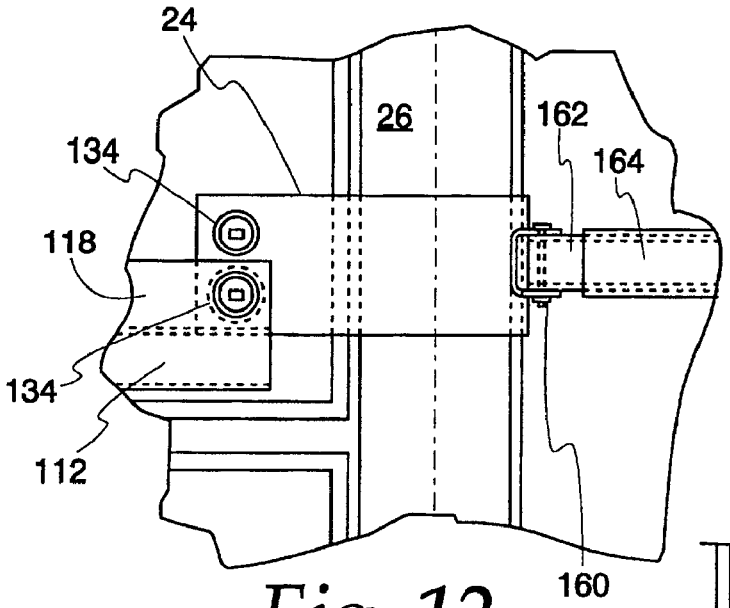
FIG. 12 is a partial side, interior elevation showing the mounting of a filled tube, flat panel and logo panel bar.
Figure 13:
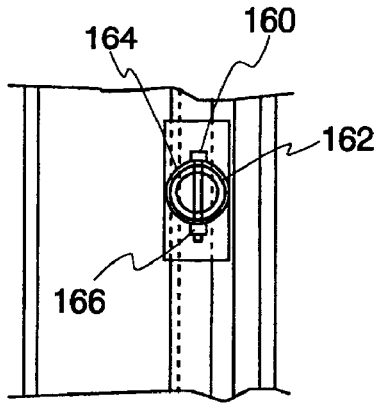
FIG. 13 is a partial front, interior elevation showing the mounting of a logo panel bar.
Figure 14:
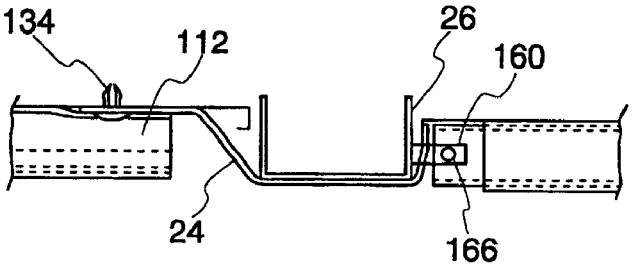
FIG. 14 is a partial top, interior plan view showing the mounting of a filled tube, flat panel and logo panel bar.

Another component of the overall system is a substantially flat foam strut covering piece 24, as seen in FIG. 5, that goes over the supporting posts on struts 26 of a conventional railcar, as seen in FIGS. 8 and 9. These struts are between sections of the railcar side walls, and the covering piece 24 serves to provide protection between these side wall sections where protection is not provided by the double or single tube protectors 12 or 18. The covering piece 24 may be of varying length and width to accommodate various types and sizes of supporting struts. The strut covering piece 24 should be wide enough to offer protection for various heights of door trim. Multiple slots 28 along the edges of the post covering piece 24 are adapted to accommodate penetrating fasteners and allow for ample fastening flexibility. Also shown in FIGS. 8 and 9 are a cross brace covering piece 32 may be of add protection wherever cross bracing is used in the railcar. The covering piece 32 may be of varying length and width to accommodate various types and sizes of cross bracing.

In the preferred embodiment of the present invention, the double tube door edge material 12 may slightly overlap the flat railcar post covering pieces 24. During installation, the post or strut covering pieces 24 are installed first. Then the double tube sections 12 are applied, with varying end portions 30 of the double tube door edge protection material 12 overlapping the post covering pieces 24, as seen in FIGS. 8 and 9. If there are diagonal struts these may be covered as well by slightly larger flat pieces 24.

Figure 6:
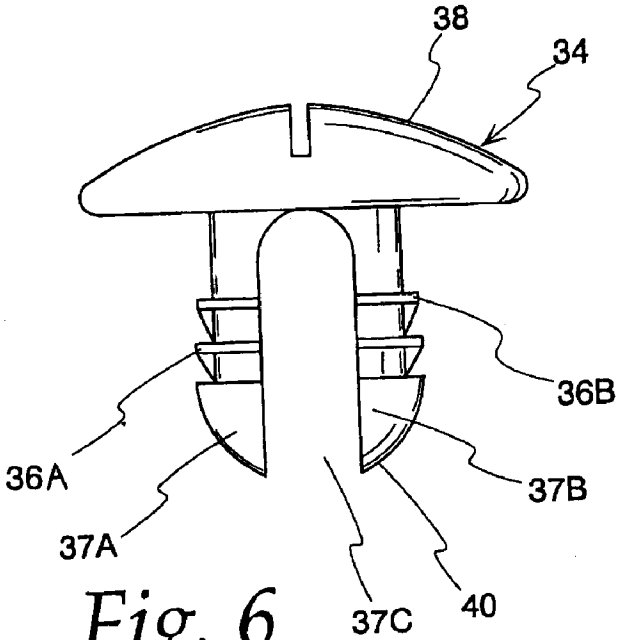
FIG. 6 is a side elevational view of the push pin fastener that is used to mount the various embodiments of the foam cushioning material of the present invention to the metal screen of a conventional autorack railcar.

With specific reference to FIG. 6, the preferred fastening system is a fastener 34 with a large head 38 having a pair of penetrating legs 37*a* and 37*b* separated by a space 37*c*. This configuration assures resilience in two legs. Each leg has special locking edges 36*a* and 36*b* designed specifically for the side panels of a conventional autorack railcar. There are preferably two pair of locking edges. The first pair of locking edges 36*a* (toward the fastener head 38) are engaged with the exterior of the steel side panel when a single layer of foam 24 is applied. When the fastener 34 needs to attach two layers of foam 24 to the steel side panel, as in the case of an overlap of adjacent system parts, the second pair of locking edges 36*b* is engaged with the exterior of the steel side panel.

Fastener 34 is easily installed but very hard to remove. The linearly extending bottom portion 40 of the fastener 34 is preferably rounded and protrudes to the outside surface of the side walls of the freight car no more than ⅝". The fastener 34 is preferable made of nylon to allow it to handle a temperature range of −40° F. to +180° F., and is not affected by the vibration of the moving freight car.

At those portions of the railcar where no holes in the side screening walls exist, known to one of skill in the art as "Logo" panels, the original foam material 24 of the present invention is either glued to the walls or holes can be drilled for the fasteners 34. The variously formed embodiments of the invention may be used together in the conventional autorack railcar as shown in FIG. 8 and 9.

The OLETEX material previously disclosed can advantageously be formed so as to have a film or "skin" applied. The 4 pound olefin foam with a skin applied 110 is identified using Surlyn as a trade name and is noted for having the film laminated on one side only. Indeed, laminating on the interior side facing the auto door has advantages in durability from contact with the door, while laminating the exterior side contacting the rail car side wall has advantages in improving durability and protection from environmental contamination that passes through the wall. Thus, lamination on both sides would also be within the contemplation of this invention. This material 110 available from OLETEX is a heat bonded film applied to the foam during the manufacturing process using a proprietary heating process.

The modified embodiment of the invention (FIGS. 10, 11, 12, 13 and 14) is a multiple foam, single tube configuration foam protector 112. The tube 112, which may be arrayed in pairs on each level of the car, will resiliently be engaged by and collapse when hit by a car door but quickly bounce back regardless of temperature. In this embodiment there are two tubes but it will be understood that there can be several tubes or even a single tube, as will be further explained.

The single tube assembly 112 in the modified embodiment utilizes a filled tube rather than a hollow tube (with or without closed ends) of the original embodiment. The tube 112 is formed of 4 pounds density foam material 110 to which a lighter density foam (1.2 to 1.7 lbs.) core 114 is inserted. An end cap can also be inserted and fastened with glue or heat or both. Core 114 can be composed, for example, from an expanded or foamed polyethylene sized to have a contact with the entire rolled tube interior surface. This unit comprises a filled tube portion 116

The filled tube portion 116 is bonded, by heat or glue, or other plastic bonding method such as ultrasonic welding, to a film coated foam mounting sheet 118 using a bonding process which heats the tube and the back side of the laminated foam mounting sheet, and joins them together using heat and pressure to make physical contact for an improved bond or weld. In the bonding operation, the heat is preferably generated by fixed hot guns, which apply heat to the two contacting surfaces of portion 116 and sheet 118 as they pass through and are then pressed together. These elements together form tube assembly 112. As will be noted in the uninstalled tube shown in FIG. 17 and 18, the heat sealed surface between of portion 116 and sheet 118 extends about 135 degrees, which provides a considerable overlap when installed. Indeed, the overlapped portion provides additional cushioning by virtue of a double layer of material 110.

Slotted holes 122 accommodate penetrating fasteners and allow for ease in installation. As with the earlier embodiment, these can be distended by inserting the fastener, but as described below, an improved fastener geometry is used.

Figure 19:
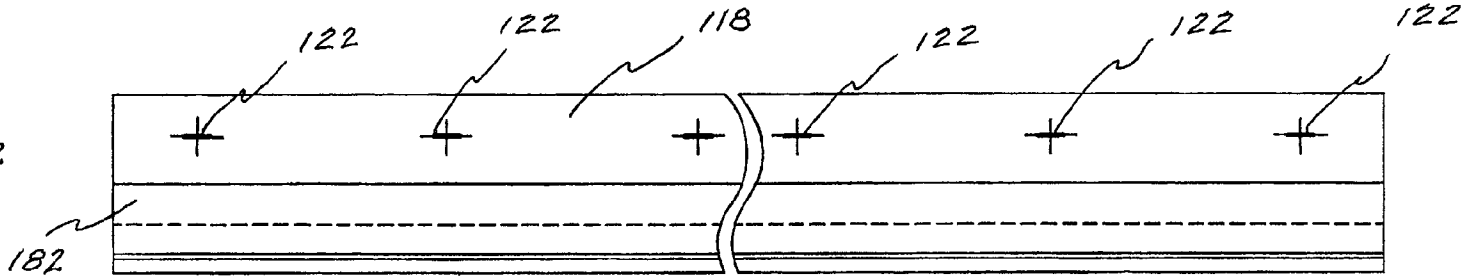
FIG. 19 is a front elevational view illustrating an alternative embodiment of an uninstalled single tube door protector in accordance with the present invention.
Figure 20:
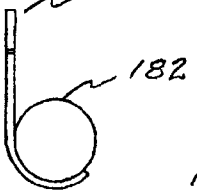
FIG. 20 is a side elevational view of the alternative embodiment of FIG. 19.

An alternative embodiment of the invention is shown in FIGS. 19 and 20. Although a single rod configuration is illustrated, it should be understood that the embodiment depicted in FIGS. 19 and 20 could easily be produced with one, two, or more rods. In its illustrated form, the foam protector 182 is a rod or cylinder formed from an extruded foam plank, of approximately 1.6 to 2.2 pound polyethylene, and is about 3 inches in diameter. The rod or cylinder 182 is preferably solid in cross-section. Of course, the precise dimensions of the foam extrusion are not critical. Just as described above with reference to the other embodiments of the invention, the protector utilizing the foam rod 182 may also be disposed in the desired combination (singly, in pairs, or otherwise) on each level of the car, and will resiliently be engaged by and collapse when hit by a car door but quickly bounce back regardless of temperature.

The foam rod 182 is also bonded, by heat or glue, or other plastic bonding method such as ultrasonic welding, to a film coated foam mounting sheet 118 using a bonding process which heats the foam rod and the back side of the laminated foam mounting sheet, and joins them together using heat and pressure to make physical contact for an improved bond or weld. In the bonding operation, the heat is preferably generated by fixed hot guns, which apply heat to the two contacting surfaces of the foam rod 182 and the sheet 118 as they pass through and are then pressed together. Just as in the prior embodiment, the heat sealed surface between the foam rod 182 and the sheet 118 extends about 135 degrees, which provides a considerable overlap when installed. The foam mounting sheet 118 is preferably about one-quarter inch thick, and is formed from a 3 pound, closed cell white foam with a coating of Surlyn film applied to the back side (the side away from the foam rod 182) to a thickness of about 8 to 10 mils. Of course, a thicker or heavier closed cell foam could also be used as a mounting sheet 118, and the thickness of the film applied to the back side may vary. It may even be possible to utilize foam of a lower density successfully.

Just as described previously, slotted holes 122 accommodate penetrating fasteners and allow for ease in installation. Modified fastener 134 (FIGS. 15, 16) is easily installed but very hard to remove. The linearly extending bottom portion 140 of the fastener 134 is notably sharper than the prior rounded bottom portion 40.

Fastener 134 uses a proportionately larger head 138 having a pair of penetrating legs 137*a* and 137*b* separated by a space 137*c*. This configuration assures resilience in two legs. Locking edges 136*a* and 136*b* engage the side panels of a conventional autorack railcar. There are preferably two pair of locking edges, in addition to the edge where the tip region 142 begins. The first pair of locking edges 136*a*

(toward the fastener head 138) are engaged with the exterior of the steel side panel when a single layer of foam is applied. When the fastener 134 needs to attach two layers of foam to the steel side panel, as in the case of an overlap of adjacent system parts, the second pair of locking edges 136*b* is engaged with the exterior of the steel side panel.

While tip region 142 this also protrudes to the outside surface of the side walls of the freight car it is easier to install in the field, as it aligns with side wall openings easier, these often being fastened "blind" because the tubes obscure the openings, and is generally somewhat longer than fastener 34, by about 14 to nearly about 40 percent, at the tip region 142. As the tip 142 protrudes from the car wall, it is advisable to form fastener 134 of a plastic that is resistant to degradation from exposure to ultraviolet light, and inclusion of a black pigment, such as carbon-black, can economically promote resistance to UV degradation when exposed to sunlight.

It will be noted that points 144*a* and 144*b* actually converge closing the dimension of space 137*c* in tip region 142 for improved penetration of slot 122.

It has also been determined that the improved fastener 134 can be advantageously mounted with use of a large washer 150 under the button head 138. This feature enables improved mechanical fastening of the foam, with a combination of effectively changing the tolerances—the depth of the fastener or dimension between the underside of the head 138 and the lips or barbs 136*a*, 136*b*, that engage the exterior surface of the autorack car panels, and also increasing the surface area of foam captured between the button head 138 and the autorack car side wall panels. The use of multiple the lips or barbs 136*a* and 136*b* on the button provides greater options in applying the system in the field—a tight fit being permitted either with or without the washer 150.

As with the earlier embodiment, it is necessary to have a solution for door edge protection at those portions of the railcar where no holes in the side screening walls exist—the "Logo" panels. In the modified embodiment, however, a bracket 160 is used to support a PVC pipe 162 with a foam overlay sleeve 164. Bracket 160 retains pipe 162 with fasteners 166 such as nuts, bolts and washers. This PVC pipe 162 with foam covering 164 is usable on "Logo" panels that do not have holes on the side screening to which buttons would be normally used. PVC pipe has advantages in low cost, resiliency, durability and ease of machining.

Various features of the invention have been particularly shown and described in connection with the illustrated embodiment of the invention. However, it must be understood that these particular arrangements merely illustrate, and that the invention is to be given its fullest interpretation within the terms of the appended claims.

We claim:

1. A door edge protection system mountable in conventional autorack railcars for transporting automobiles having side doors, each said railcar having side walls with holes therethrough, said system including:

a resilient foamed cushioning material covering a portion of at least one of said railcar side walls at the level of the doors of the automobiles being transported, so that when the door of one of the automobiles is opened the material will be positioned between the door and the railcar side wall covered by said material for cushioning and protecting the automobile door edge against impact with the railcar side wall; and penetrating fasteners formed and arranged for securely fastening said cushioning material to the inner surface of the side walls, each of said fasteners having a leg extending through said cushioning material and adapted to fit into at least one of the holes in the railcar side wall, and having a locking formation on said fastener leg for engaging the exterior of the side wall and locking said fastener in place after said fastener leg has passed through the hole in the side wall; said resilient foamed cushioning material being formed from a first, substantially flat piece of foam material, and a second, substantially cylindrical piece of foam material;

said substantially flat piece being at least partially rolled over and bonded to the second substantially cylindrical piece to form a cushioning element;

said cushioning element being constructed and arranged such that a mounting portion is also formed in said substantially flat piece, distal from said substantially cylindrical piece, the mounting portion adapted to receive said fasteners and be captured between each said fastener and the side wall.

2. A door edge protection system for conventional autorack railcars for transporting automobiles, each said railcar having side walls with a plurality of holes therethrough, said system including:

resilient cushioning material formed from a first, substantially flat piece of foam material, and a second, substantially cylindrical piece of foam material;

said substantially flat piece being at least partially rolled over and bonded to the second substantially cylindrical piece to form a cushioning element;

said cushioning element being constructed and arranged such that a mounting portion is also formed in said substantially flat piece, distal from said substantially cylindrical piece, the mounting portion adapted to receive fasteners and be captured between said fastener and one of said side walls;

a plurality of penetrating fasteners, each having an enlarged head and a leg with a resilient locking formation thereon, whereby the leg of each fastener extends through said mounting portion and through a corresponding one of the holes in the railcar side wall with the locking formation engaging the exterior of the side wall adjacent the hole to lock the fastener in place and securely hold the cushioning element against the interior of the railcar side wall.

3. A door edge protection system mountable in conventional autorack railcars for transporting automobiles having side doors, each said railcar having side walls with holes therethrough, said system including:

a resilient foamed cushioning material covering a portion of at least one of said railcar side walls at the level of the doors of the automobiles being transported, so that when the door of one of the automobiles is opened the material will be positioned between the door and the railcar side wall covered by said material for cushioning and protecting the automobile door edge against impact with the railcar side wall; and penetrating fasteners formed and arranged for securely fastening said cushioning material to the inner surface of the side walls, each of said fasteners having a leg extending through said cushioning material and adapted to fit into at least one of the holes in the railcar side wall, and having a locking formation on said fastener leg for engaging the exterior of the side wall and locking said fastener in place after said fastener leg has passed through the hole in the side wall;

said resilient foamed cushioning material being formed from a flat piece of foam material having a curved protection portion and a sidewall mounting portion wherein the sidewall mounting portion is fanned from the same piece of said resilient foamed cushioning material and is adapted to receive said fasteners and be captured between said fasteners and the sidewall.

* * * * *